US008821186B2

(12) United States Patent
Lan

(10) Patent No.: US 8,821,186 B2
(45) Date of Patent: Sep. 2, 2014

(54) UNIVERSAL SERIAL BUS CONNECTOR

(71) Applicant: Cheng Uei Precision Industry Co., Ltd., New Taipei (TW)

(72) Inventor: Rong Qin Lan, Dong-Guan (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 45 days.

(21) Appl. No.: 13/740,276

(22) Filed: Jan. 14, 2013

(65) Prior Publication Data

US 2014/0199892 A1 Jul. 17, 2014

(51) Int. Cl.

| | |
|---|---|
| ***H01R 13/60*** | (2006.01) |
| ***H01R 13/514*** | (2006.01) |
| ***H01R 13/6591*** | (2011.01) |
| ***H01R 27/02*** | (2006.01) |

(52) U.S. Cl.

CPC ..... *H01R 13/514* (2013.01); *H01R 13/6591* (2013.01); *H01R 27/02* (2013.01)

USPC ..... 439/541.5; 439/607.23; 439/607.34; 439/540.1

(58) Field of Classification Search

CPC ... H01R 13/514; H01R 13/6591; H01R 27/02

USPC ..... 439/540.1, 541.5, 607.23, 607.34

See application file for complete search history.

(56) References Cited

U.S. PATENT DOCUMENTS

| | | | | |
|---|---|---|---|---|
| 7,794,279 | B1 * | 9/2010 | Ye et al. | 439/607.54 |
| 7,862,378 | B1 * | 1/2011 | Wan et al. | 439/607.35 |
| 8,202,120 | B2 * | 6/2012 | Ko | 439/607.35 |
| 8,282,400 | B2 * | 10/2012 | Yang et al. | 439/55 |
| 8,641,455 | B2 * | 2/2014 | Lan | 439/660 |
| 8,668,524 | B2 * | 3/2014 | Lan et al. | 439/607.35 |
| 2013/0189878 | A1 * | 7/2013 | Lan et al. | 439/607.34 |
| 2013/0273773 | A1 * | 10/2013 | Lan et al. | 439/566 |
| 2014/0030920 | A1 * | 1/2014 | Lan et al. | 439/607.01 |

* cited by examiner

*Primary Examiner* — James Harvey
(74) *Attorney, Agent, or Firm* — Cheng-Ju Chiang

(57) ABSTRACT

A universal serial bus connector includes an insulating housing, a plurality of terminals disposed to the insulating housing, a dielectric base, a first shielding shell surrounding the insulating housing, and a second shielding shell. Each of the terminals has a fastening portion, and a soldering portion slantwise extending upward and rearward from a rear end of the fastening portion to be exposed behind the insulating housing. The dielectric base disposed to a rear end of the insulating housing defines a plurality of rows of insertion slots and resisting surfaces exposed behind the insulating housing. The soldering portions are inserted into the insertion slots and abut against the resisting surfaces. The second shielding shell disposed to rear ends of the insulating housing and the first shielding shell includes a first main board and a second main board parallel with the soldering portions abutting against the resisting surfaces.

10 Claims, 5 Drawing Sheets

UNIVERSAL SERIAL BUS CONNECTOR

BACKGROUND OF THE INVENTION

1. Field of the Invention

The present invention generally relates to a connector, and more particularly to a universal serial bus connector.

2. The Related Art

In recent years, with the rapid development of economy, people's daily lives have been significantly improved. In order to satisfy people's growing needs of material culture lives, a variety of electronic products and peripheral devices are used in the people's daily lives. As is known to all, universal serial bus connectors are common-used components of the electronic products and the peripheral devices. Generally, the universal serial bus connector includes an insulating housing, a plurality of terminals, and a shielding shell surrounding the insulating housing. The insulating housing defines a receiving space penetrating through a front thereof, and a plurality of terminal grooves. Each of the terminal grooves penetrates through a rear thereof and communicates with the receiving space. Each of the terminals has a fastening portion, a contact portion connecting with one end of the fastening portion, and a soldering portion connecting with the other end of the fastening portion. The terminals are disposed to the terminal grooves of the insulating housing with the contact portions thereof projecting into the receiving space and the soldering portions thereof projecting behind the insulating housing to be soldered with a plurality of core wires of a cable.

However, in the process of the core wires of the cable being soldered with the soldering portions of the terminals, the soldering portions of the terminals are apt to sway that makes the core wires of the cable be soldered with the soldering portions of the terminals unsteadily. As a result, a soldering quality of the universal serial bus connector is affected.

SUMMARY OF THE INVENTION

An object of the present invention is to provide a universal serial bus connector. The universal serial bus connector includes an insulating housing, a plurality of terminals, a dielectric base, a first shielding shell surrounding the insulating housing, and a second shielding shell. The insulating housing has a top wall, two side walls extending downward from two opposite sides of the top wall, and a bottom wall connecting with two bottoms of the two side walls. A receiving space is formed among the top wall, the two side walls and the bottom wall. The terminals are disposed to the insulating housing. Each of the terminals has a fastening portion, a contact portion connecting with a front end of the fastening portion to be partially exposed to the receiving space or above the insulating housing, and a soldering portion slantwise extending upward and rearward from a rear end of the fastening portion to be exposed behind the insulating housing. The dielectric base disposed to a rear end of the insulating housing includes a first main body, a second main body protruding downward from a bottom surface of the first main body, and a third main body protruding downward from a bottom surface of the second main body. The dielectric base defines a plurality of rows of spaced insertion slots separately penetrating through the first main body, the second main body and the third main body along a front-to-rear direction, and a plurality of rows of spaced resisting surfaces inclined upward and rearward from a rear end of a top sidewall of the insertion slots and exposed behind the insulating housing, the soldering portions are inserted into the insertion slots and abut against the resisting surfaces. The second shielding shell is disposed to rear ends of the insulating housing and the first shielding shell. The second shielding shell includes a lower shell and an upper shell matched with the lower shell. The lower shell has a first main board slantwise disposed upward and rearward. The upper shell has a second main board slantwise disposed upward and rearward. The first main board and the second main board are parallel with the soldering portions of the terminals abutting against the resisting surfaces of the dielectric base.

As described above, the soldering portions which slantwise extends upward and rearward of the terminals abut against the upward and rearward inclined resisting surfaces of the dielectric base which are arranged in the plurality of parallel rows and in a stair shape, and the first main board of the lower shell and the second main board of the upper shell are parallel with the soldering portions of the terminals abutting against the resisting surfaces of the dielectric base. Thus, the soldering portions of the terminals soldered steadily and soldering areas of the soldering portions of the terminals are enlarged accordingly for effectively ensuring a soldering quality of the soldering portions of the terminals of the universal serial bus connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
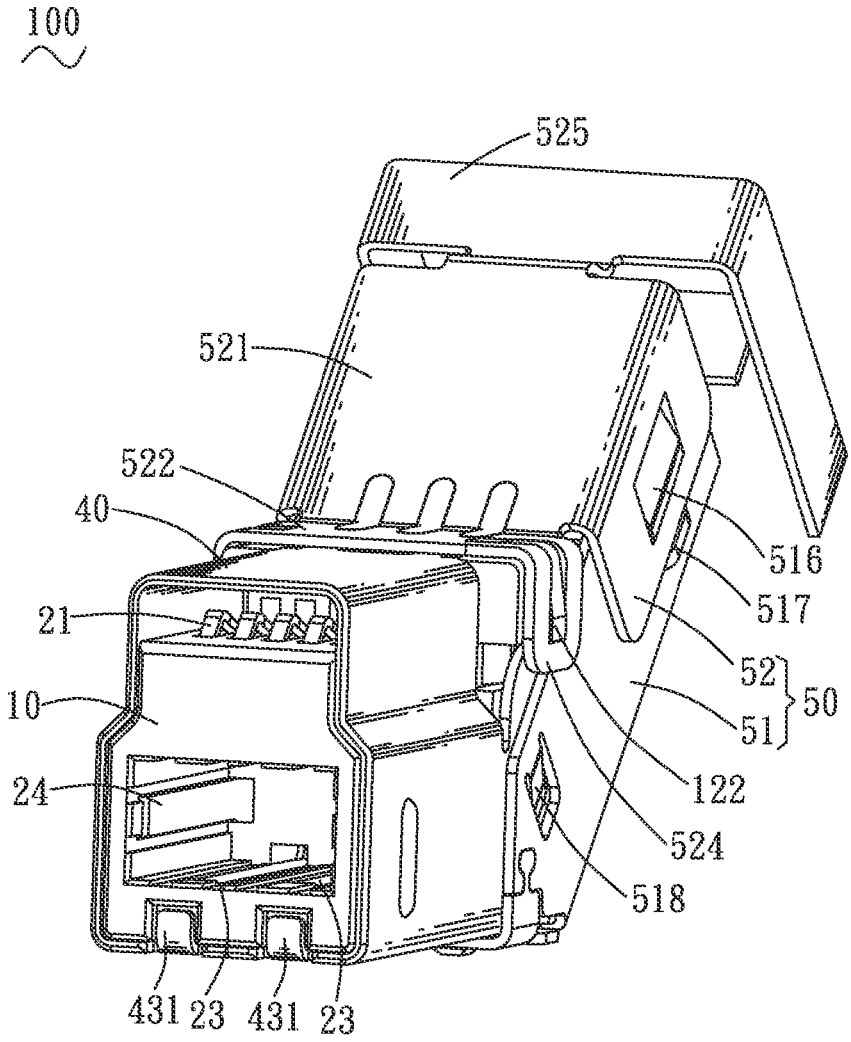
FIG. 1 is a perspective view of a universal serial bus connector in accordance with the present invention.
Figure 2:
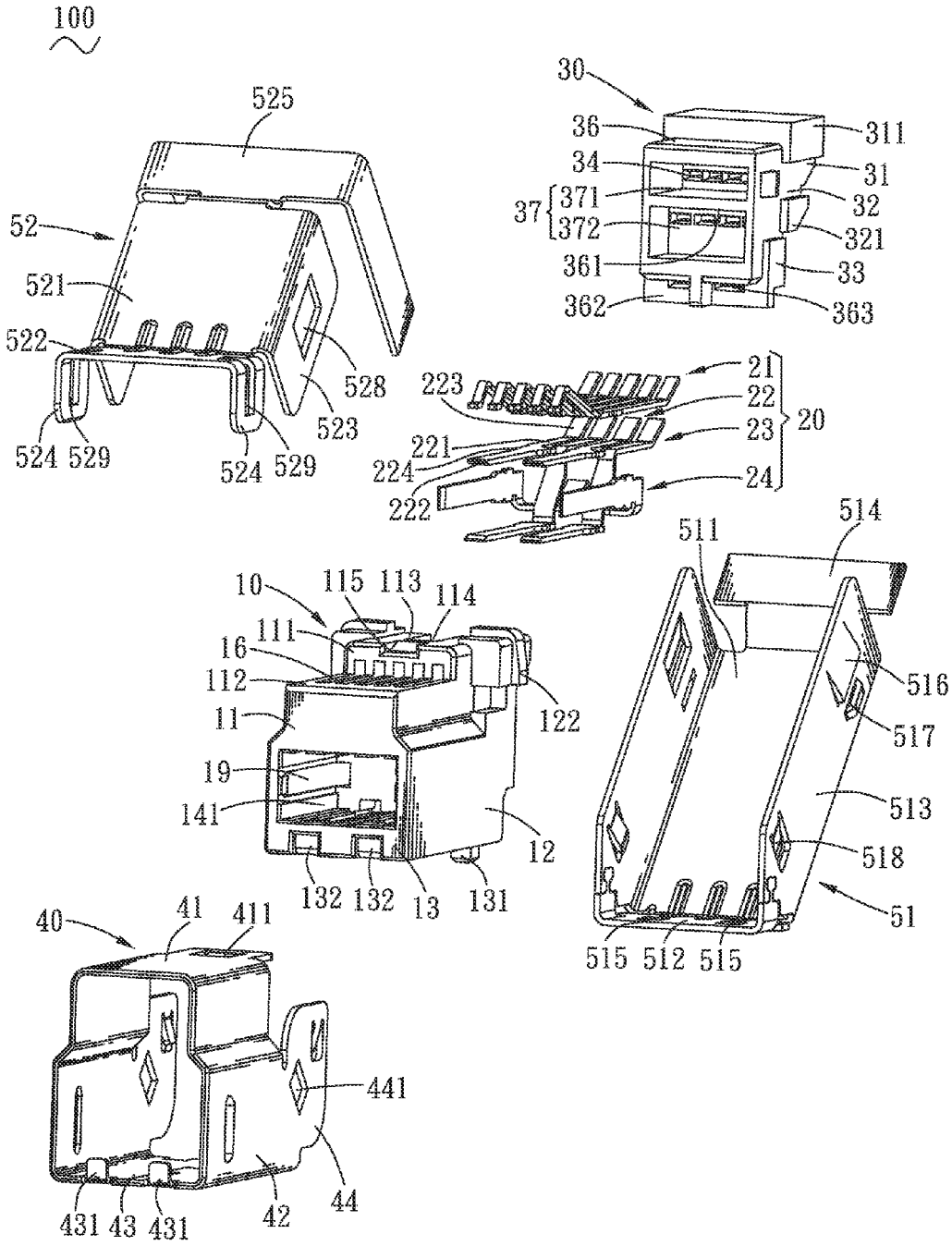
FIG. 2 is an exploded view of the universal serial bus connector of FIG. 1.

With reference to FIG. 1 and FIG. 2, an universal serial bus connector 100 in accordance with the present invention is shown. The universal serial bus connector 100 includes an insulating housing 10, a plurality of terminals 20, a dielectric base 30, a first shielding shell 40 and a second shielding shell 50.

Figure 3:
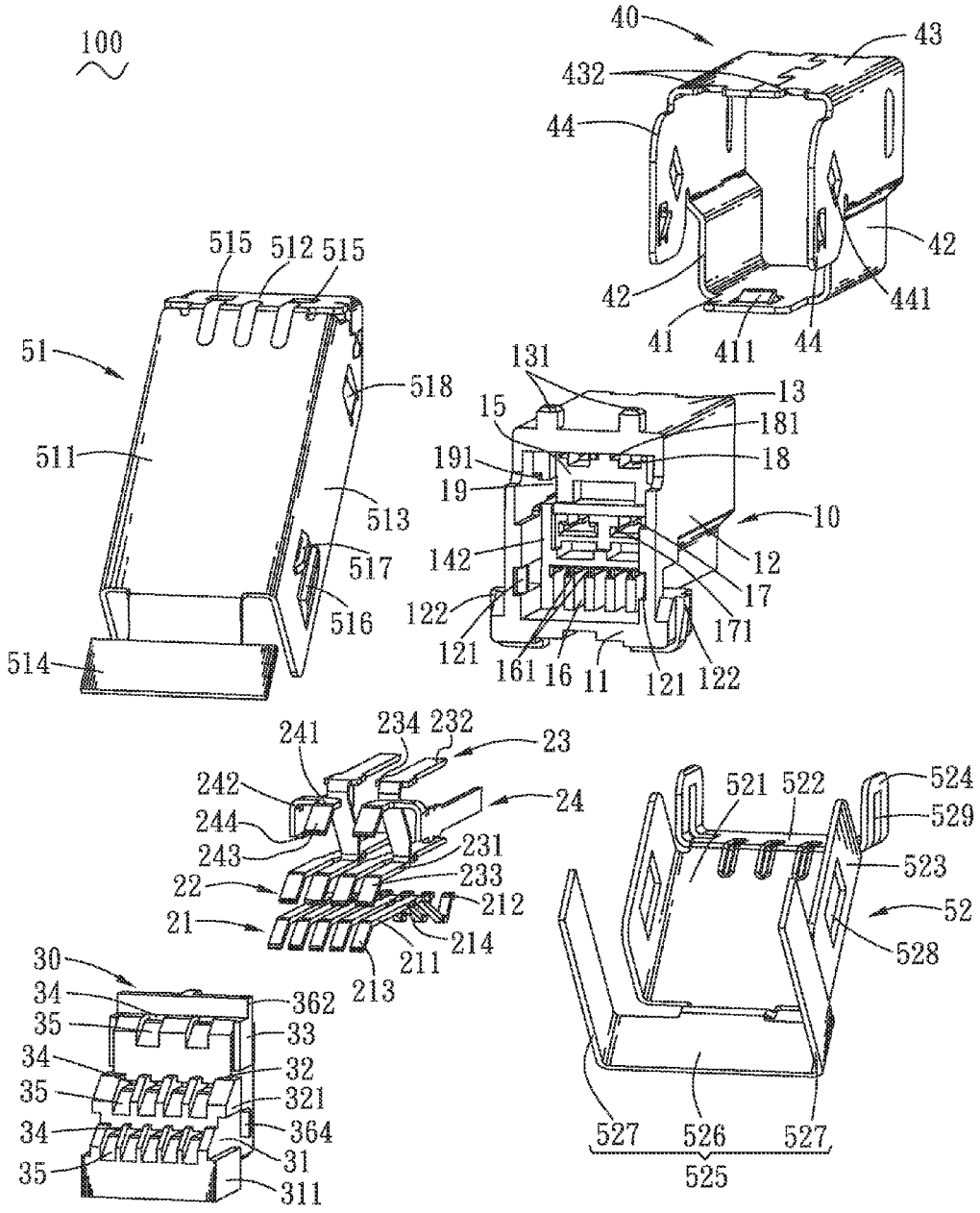
FIG. 3 is another exploded view of the universal serial bus connector of FIG. 1.
Figure 4:
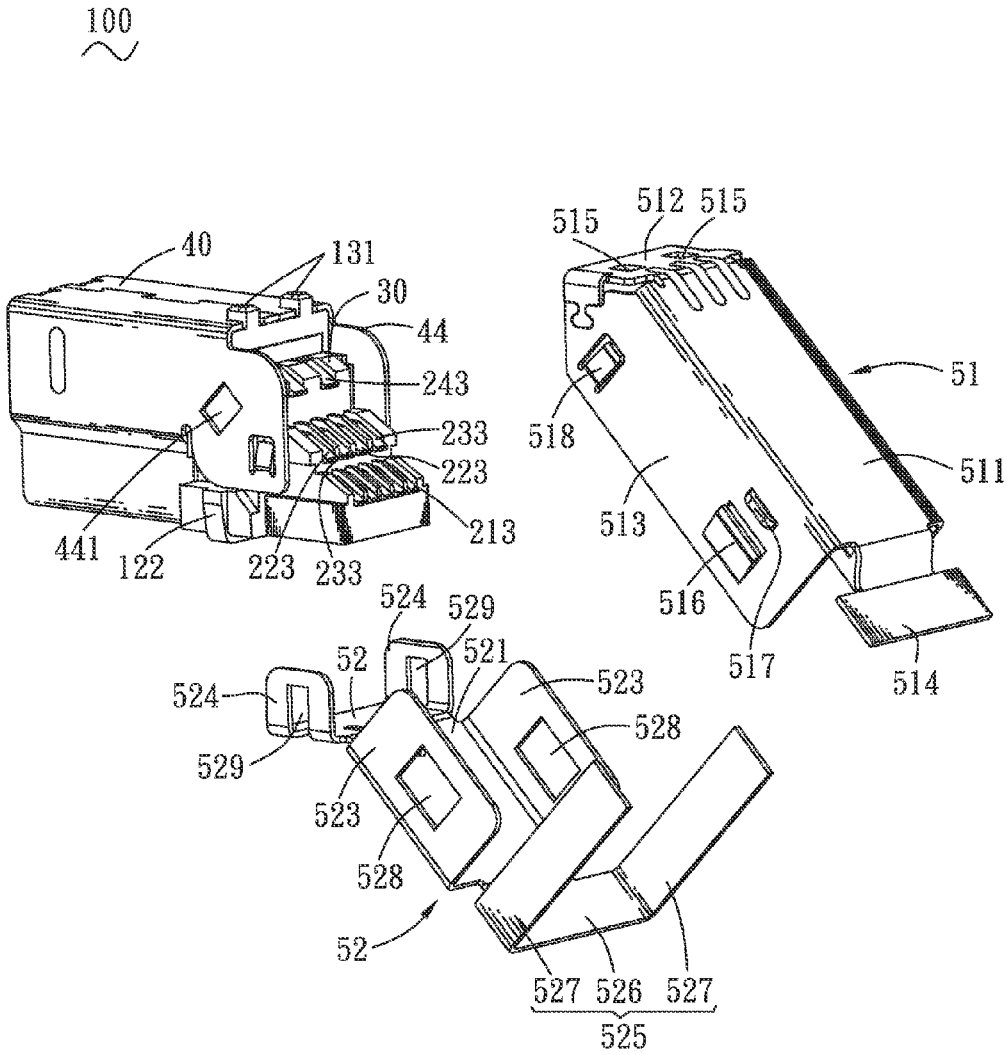
FIG. 4 is a partially exploded view of the universal serial bus connector of FIG. 1.
Figure 5:
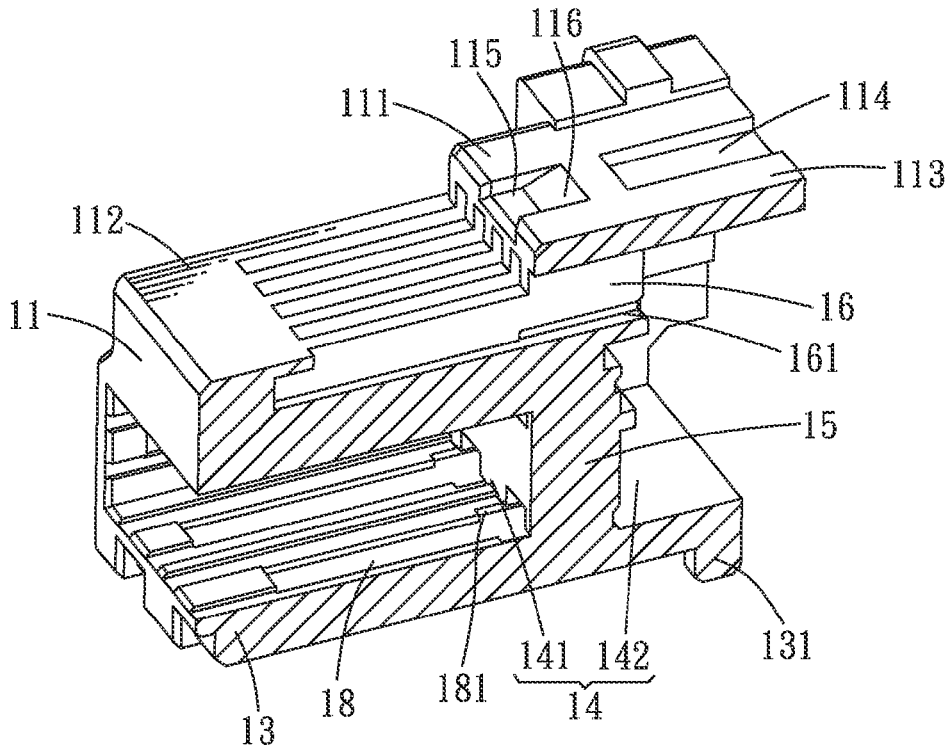
FIG. 5 is a sectional view of an insulating housing of the universal serial bus connector of FIG. 1.

Referring to FIG. 2, FIG. 3 and FIG. 5, the insulating housing 10 has a top wall 11, two side walls 12 extending downward from two opposite sides of the top wall 11, and a bottom wall 13 connecting with two bottoms of the two side walls 12. A receiving space 14 is formed among the top wall 11, the two side walls 12 and the bottom wall 13. Inner surfaces of the top wall 11, the two side walls 12 and the bottom wall 13 are connected with a connecting wall 15. The receiving space 14 is divided into a first receiving space 141 and a second receiving space 142 by the connecting wall 15. The top wall 11 includes a rectangular base body 111, a first base board 112 extending forward from a bottom of the base body 111, and a second base board 113 extending rearward from a top of the base body 111. A rear end of a middle of a top surface of the second base board 113 of the top wall 11 of the insulating housing 10 is recessed downward to form a fixing groove 114, and a front end of the middle of the top surface of the second base board 113 is recessed downward to form a guiding groove 115 passing through a front surface of the second base board 113 of the top wall 11. The fixing groove 114 and the guiding groove 115 are arranged in alignment. An inner surface of a rear sidewall of the guiding groove 115 is inclined rearward and upward to form a guiding surface 116. Two opposite sides of a rear end of a bottom surface of the bottom wall 13 of the insulating housing 10 protrude downward to form two first fastening blocks 131. Two opposite sides of a front surface of the bottom wall 13 of the insulating housing 10 are recessed inward to form two restricting grooves 132. Two upper portions of two rear ends of the two side walls 12 of the insulating housing 10 define two face-to-face buckling grooves 121. Two upper portions of two rear ends of two outer surfaces of the two side walls 12 of the insulating housing 10 protrude outward to form two second fastening blocks 122.

Referring to FIG. 2, FIG. 3 and FIG. 5 again, the top wall 11 of the insulating housing 10 defines a plurality of first terminal grooves 16 transversely arranged at regular intervals. A substantial middle of each first terminal groove 16 penetrates through a top surface of the first base board 112, and a rear end of each first terminal groove 16 penetrates through a rear surface of the base body 111 to communicate with the second receiving space 142. Two rear ends of two opposite inner surfaces of two sidewalls of the first terminal groove 16 are recessed oppositely to form two first fastening slots 161. The insulating housing 10 defines two second terminal grooves 17 passing through two opposite sides of a bottom surface of the first base board 112 and two opposite sides of a top of the connecting wall 12 to communicate with the first receiving space 141 and the second receiving space 142, and two third terminal grooves 18 passing through two opposite sides of a top surface of the bottom wall 13 and two opposite sides of a bottom of the connecting wall 15 to communicate with the first receiving space 141 and the second receiving space 142. Two rear ends of two opposite inner surfaces of two sidewalls of the second terminal groove 17 are recessed oppositely to form two second fastening slots 171. Two rear ends of two opposite inner surfaces of two sidewalls of the third terminal groove 18 are recessed oppositely to form two third fastening slots 181. The two side walls 12 define two fourth terminal grooves 19 passing through two lower portions of two inner surfaces and two rear surfaces thereof and communicating with the first receiving space 141 and the second receiving space 142. Two rear ends of two opposite inner surfaces of two sidewalls of the fourth terminal groove 19 are recessed oppositely to form two fourth fastening slots 191.

Referring to FIG. 2 and FIG. 3, the terminals 20 include five first terminals 21, a pair of second terminals 22, a pair of third terminals 23 and a pair of fourth terminals 24. Each of the terminals 20 has a fastening portion, a contact portion connecting with a front end of the fastening portion, and a soldering portion slantwise extending upward and rearward from a rear end of the fastening portion. Each first terminal 21 has an elongated first fastening portion 211 disposed horizontally, a first contact portion 212 extending forward, then arched upward and further extending forward from a front end of the first fastening portion 211, and a first soldering portion 213 slantwise extending upward and rearward from a rear end of the first fastening portion 211. Two opposite sides of the first contact portion 212 protrude outward to form two first protruding portions 214.

Referring to FIG. 2 and FIG. 3, each second terminal 22 has an elongated second fastening portion 221 disposed horizontally, a second contact portion 222 extending forward from a front end of the second fastening portion 221, and a second soldering portion 223 slantwise extending upward and rearward from a rear end of the second fastening portion 221. Two opposite sides of the second contact portion 222 protrude outward to form two second protruding portions 224. Each third terminal 23 has an elongated third fastening portion 231 disposed horizontally, a third contact portion 232 extending downward, and then extending forward from a front end of the third fastening portion 231, and a third soldering portion 233 slantwise extending upward and rearward from a rear end of the third fastening portion 231. Two opposite sides of the third contact portion 232 protrude outward to form two third protruding portions 234.

Each of the fourth terminals 24 has an elongated fourth fastening portion 241 disposed horizontally, a fourth contact portion 242 bent outward, then bent upward, and further extending forward from a front end of the fourth fastening portion 241, and a fourth soldering portion 243 slantwise extending upward and rearward from a rear end of the fourth fastening portion 241. A top and a bottom of the fourth contact portion 242 protrude oppositely to form two fourth protruding portions 244.

Referring to FIG. 2 and FIG. 3, the dielectric base 30 of a stair shape includes a first main body 31, a second main body 32 protruding downward from a front of a bottom surface of the first main body 31, and a third main body 33 protruding downward from a front of a bottom surface of the second main body 32. The dielectric base 30 defines a plurality of rows of spaced insertion slots 34 separately penetrating through the first main body 31, the second main body 32 and the third main body 33 along a front-to-rear direction, a plurality of parallel rows of spaced resisting surfaces 35 inclined upward and rearward from a rear end of a top sidewall of the insertion slots 34 and arranged in a stair shape. Two tops of two opposite side surfaces of the first main body 31 protrude outward to form two first blocking portions 311, and two bottoms of two opposite side surfaces of the second main body 32 protrude outward to form two second blocking portions 321.

Fronts of the first main body 31, the second main body 32 and the third main body 33 are connected with a fastening frame 36. A middle of the fastening frame 36 is defined as an opening 37. An isolating board 361 is connected with a substantial middle of an inner periphery of the fastening frame 36 to divide the opening 37 into a first opening 371 and a second opening 372 located under the first opening 371. The first opening 371 communicates with the insertion slots 34 which penetrate through the first main body 31 along the front-to-rear direction. The second opening 372 communicates with the insertion slots 34 which penetrate through the second main body 32 along the front-to-rear direction. A bottom surface of the fastening frame 36 is flush with a front end of a top sidewall of the insertion slot 34 which penetrates through the third main body 33 along the front-to-rear direction. A rear of the bottom surface of the fastening frame 36 extends downward to form a supporting block 362. Two opposite sides of a top of the supporting block 362 define two narrow slots 363 respectively communicating with the insertion slots 34 which penetrate through the third main body 33. Two tops of two opposite side surfaces of the fastening frame 36 protrude outward to form two buckling blocks 364.

Referring to FIG. 2 and FIG. 3, the first shielding shell 40 looped from a metal plate has a top plate 41, two lateral plates 42 extending downward, then inclined outward, and further extending downward from two opposite sides of the top plate 41, and a bottom plate 43 extending towards each other from two bottoms of the two lateral plates 42. Two lower portions of the two lateral plates 42 extend rearward to form two connecting plates 44. An insertion space 45 is formed among the top plate 41, the two lateral plates 42 and the bottom plate 43. A middle of a rear end of the top plate 41 is punched downward to form a fixing piece 411. Two opposite sides of a front edge of the bottom plate 43 are bent upward to form two restricting pieces 431. Two opposite sides of a rear edge of the bottom plate 43 are recessed inward to form two recesses 432. The connecting plate 44 defines a clipping hole 441.

Referring to FIG. 1, FIG. 2, FIG. 3 and FIG. 4, the second shielding shell 50 includes a lower shell 51 and an upper shell 52 matched with the lower shell 51. The lower shell 51 has a first main board 511 slantwise disposed upward and rearward, a first fastening board 512 extending forward from a front end of the first main board 511, two first flanks 513 extending upward and perpendicular to the first main board 511 from two opposite sides of the first main board 511, and connecting with two opposite ends of the first fastening board 512, and a first clipping portion 514 connecting with a rear end edge of the first main board 511. Two opposite sides of the first fastening board 512 define two first fastening holes 515. Two portions of a rear end of each first flank 513 are punched outward to form a buckling piece 516, and a limiting portion 517 located under the buckling piece 516. A front end of each first flank 513 is punched inward to form a clipping piece 518.

Referring to FIG. 2 and FIG. 3, the upper shell 52 has a second main board 521 slantwise disposed upward and rearward, a second fastening board 522 extending forward from a front end of the second main board 521, two second flanks 523 extending downward and perpendicular to the second main board 521 from two opposite sides of the second main board 521, two fastening arms 524 extending downward and perpendicular to the second fastening board 522 from two opposite sides of the second fastening board 522, and a second clipping portion 525 connecting with a rear edge of the second main board 521. The second clipping portion 525 includes a clipping board 526, and two clipping arms 527 extending downward and perpendicular to the clipping board 526 from two opposite sides of the clipping board 526. A middle of the clipping board 526 is connected with a middle of the rear edge of the second main board 521. Each second flank 523 has a buckling hole 528. Each fastening arm 524 defines a second fastening hole 529.

Referring to FIG. 1, FIG. 2, FIG. 3, FIG. 4 and FIG. 5, when the universal serial bus connector 100 is assembled, at first, the terminals 20 are disposed to the insulating housing 10. The contact portions of the terminals 20 are partially exposed to the first receiving space 141 of the receiving space 14 or above the insulating housing 10. Rear ends of the fastening portions and soldering portions are exposed behind the insulating housing 10, and front ends of the fastening portions thereof being located in the second receiving space 142. Specifically, each of the first terminals 21 is disposed to the first terminal groove 16. A front end of the first contact portion 212 thereof is received in a front end of the first terminal groove 16 with a part thereof being exposed beyond a top of the first terminal groove 16 of the insulating housing 10. The two first protruding portions 214 respectively interfere with two opposite inner surfaces of two sidewalls of the two first fastening slots 161. A front end of the first fastening portion 211 is located in the second receiving space 142. A rear end of the first fastening portion 211 and the first soldering portion 213 are exposed behind the insulating housing 10.

Each of the second terminals 22 is disposed to the second terminal groove 17. A front end of the second contact portion 222 is exposed to the first receiving space 141. The two second protruding portions 224 respectively interfere with two opposite inner surfaces of the two sidewalls of the two second fastening slots 171. A front end of the second fastening portion 221 is located in the second receiving space 142. A rear end of the second fastening portion 221 and the second soldering portion 223 are exposed behind the insulating housing 10.

Each of the third terminals 23 is disposed to the third terminal groove 18. A front end of the third contact portion 232 is exposed to the first receiving space 141. The two third protruding portions 234 respectively interfere with two opposite inner surfaces of two sidewalls of the two third fastening slots 181. A front end of the third fastening portion 231 and a rear end of the third contact portion 232 are located in the second receiving space 142. A rear end of the third fastening portion 231 and the third soldering portion 233 are exposed behind the insulating housing 10. Because the third terminal 23 has the third contact portion 232 which extends downward, and then extends forward from the front end of the third fastening portion 231, at the time of the front end of the third contact portion 232 being exposed to the first receiving space 141, the second soldering portions 223 and the third soldering portions 233 are arranged in the same plane.

Each of the fourth terminals 24 is disposed to the fourth terminal groove 19. A front end of the fourth contact portion 242 is exposed to the first receiving space 141. The two protruding portions 244 respectively interfere with two opposite inner surfaces of two sidewalls of the two fourth fastening slots 191. A rear end of the fourth contact portion 242 and a front end of the fourth fastening portion 241 are located in the second receiving space 142. A rear end of the fourth fastening portion 241 and the fourth soldering portion 243 are exposed behind the insulating housing 10.

Next, the dielectric base 30 is disposed to a rear end of the insulating housing 10 with a front end thereof projecting into the second receiving space 142. Specifically, front ends of the first main body 31, the second main body 32, the third main body 33 and the supporting block 362 are received in the second receiving space 142. The two buckling blocks 364 are buckled in the two buckling grooves 121. A top portion of the first main body 31 is blocked behind a rear surface of the top wall 11. The two first blocking portions 311 and the two second blocking portions 321 are blocked behind the rear surfaces of the two side walls 12. Rear ends of the first main body 21, the second main body 32 and the third main body 33, and the resisting surfaces 35 are exposed behind the insulating housing 10.

The soldering portions and the rear ends of the fastening portions of the terminals 20 are separately inserted into the insertion slots 34 and abut against the resisting surfaces 35 of the dielectric base 30 through the first opening 371, the second opening 372 and the narrow slots 363. Specifically, the first soldering portions 213 and the rear ends of the first fastening portions 211 are inserted rearward into the insertion slots 34 through the first opening 371, and the first soldering portions 213 abut against the corresponding resisting surfaces 35. The second soldering portions 223 and the rear ends of the second fastening portions 221, and the third soldering portions 233 and the rear ends of the third fastening portions 231 are respectively inserted rearward into the insertion slots 34 through the second opening 372, and the second soldering portions 223 and the third soldering portions 233 respectively abut against the corresponding resisting surfaces 35. The fourth soldering portions 243 and the rear ends of the fourth fastening portions 241 are inserted rearward into the insertion slots 34 through the narrow slots 363, and the fourth soldering portions 243 abut against the corresponding resisting surfaces 35. So the soldering portions are arranged in a plurality of parallel rows and in the stair shape.

Again, the first shielding shell 40 surrounds the insulating housing 10, specifically, the insulating housing 10 together with the terminals 20 and the dielectric base 30 is inserted forward into the insertion space 45 of the first shielding shell 40. The two first fastening blocks 131 of the insulating housing 10 are fastened in the two recesses 432 of the first shielding shell 40. The fixing piece 411 of the first shielding shell 40 is fixed in the fixing groove 114 along the guiding surface 116, and the two restricting pieces 431 of the first shielding shell 40 are restricted in the two restricting grooves 132. So, the first shielding shell 40 is fastened to the insulating housing 10.

The universal serial bus connector 100 is soldered with a cable (not shown) which includes a plurality of core wires (not shown). The core wires of the cable are soldered with the soldering portions of the terminals 20 which are arranged in the plurality of parallel rows and in the stair shape.

At last, the second shielding shell 50 is disposed to rear ends of the insulating housing 10 and the first shielding shell 40. Specifically, the two first fastening blocks 131 of the insulating housing 10 are fastened in the two first fastening holes 515 of the lower shell 51, the two clipping pieces 518 of the lower shell 51 are clipped in the two clipping holes 441 of the first shielding shell 40, and the lower shell 51 is connected with the bottom plate 43 and the two connecting plates 44 of the first shielding shell 40 so that the lower shell 51 is fastened to the rear ends of the insulating housing 10 and the first shielding shell 40. The two second fastening blocks 122 of the insulating housing 10 are fastened in the two second fastening holes 529 of the upper shell 52, and the upper shell 52 is connected with the top plate 41 of first shielding shell 40 so that the upper shell 52 is fastened to the rear ends of the insulating housing 10 and the first shielding shell 40. The two buckling pieces 516 of the lower shell 51 are buckled in the two buckling holes 528 of the upper shell 52, and two bottoms of the two second flanks 523 resist against two tops of the two limiting portions 517 so that the upper shell 52 is fastened to the lower shell 51. The second clipping portion 525 of the upper shell 52 is disposed above the first clipping portion 514 of the lower shell 51. The cable is located between the lower shell 51 and the upper shell 52 with a rear end thereof projecting behind the lower shell 51 and the upper shell 52. The two clipping arms 527 are bent towards each other to clip the cable between the first clipping portion 514 and the second clipping portion 525. The soldering portions which slantwise extends upward and rearward of the terminals 20 abut against the upward and rearward inclined resisting surfaces 35 of the dielectric base 30 which are arranged in the plurality of parallel rows and in the stair shape, and the first main board 511 of the lower shell 51 and the second main board 521 of the upper shell 52 are parallel with the soldering portions of the terminals 20 abutting against the resisting surfaces 35 of the dielectric base 30, so that the core wires of the cable are soldered with the soldering portions of the terminals 20 steadily and soldering areas of the soldering portions of the terminals 20 are enlarged accordingly.

As described above, the soldering portions which slantwise extends upward and rearward of the terminals 20 abut against the upward and rearward inclined resisting surfaces 35 of the dielectric base 30 which are arranged in the plurality of parallel rows and in the stair shape, and the first main board 511 of the lower shell 51 and the second main board 521 of the upper shell 52 are parallel with the soldering portions of the terminals 20 abutting against the resisting surfaces 35 of the dielectric base 30. Thus, the core wires of the cable are soldered with the soldering portions of the terminals 20 steadily and soldering areas of the soldering portions of the terminals 20 are enlarged accordingly for effectively ensuring a soldering quality of the soldering portions of the terminals 20 of the universal serial bus connector 100 being soldered with the core wires of the cable.

What is claimed is:

1. An universal serial bus connector, comprising:

an insulating housing having a top wall, two side walls extending downward from two opposite sides of the top wall, and a bottom wall connecting with two bottoms of the two side walls, a receiving space being formed among the top wall, the two side walls and the bottom wall;

a plurality of terminals disposed to the insulating housing, each of the terminals having a fastening portion, a contact portion connecting with a front end of the fastening portion to be partially exposed to the receiving space or above the insulating housing, and a soldering portion slantwise extending upward and rearward from a rear end of the fastening portion to be exposed behind the insulating housing;

a dielectric base disposed to a rear end of the insulating housing, the dielectric base including a first main body, a second main body protruding downward from a bottom surface of the first main body, and a third main body protruding downward from a bottom surface of the second main body, the dielectric base defining a plurality of rows of spaced insertion slots separately penetrating through the first main body, the second main body and the third main body along a front-to-rear direction, and a plurality of rows of spaced resisting surfaces inclined upward and rearward from a rear end of a top sidewall of the insertion slots and exposed behind the insulating housing, the soldering portions being inserted into the insertion slots and abutting against the resisting surfaces;

a first shielding shell surrounding the insulating housing; and a second shielding shell disposed to rear ends of the insulating housing and the first shielding shell, the second shielding shell including a lower shell and an upper shell matched with the lower shell, the lower shell having a first main board slantwise disposed upward and rearward, the upper shell having a second main board slantwise disposed upward and rearward, the first main board and the second main board being parallel with the soldering portions of the terminals abutting against the resisting surfaces of the dielectric base.

2. The universal serial bus connector as claimed in claim 1, wherein two opposite side surfaces of the first main body protrude outward to form two first blocking portions, and two opposite side surfaces of the second main body protrude outward to form two second blocking portions, the two first blocking portions and the two second blocking portions are blocked behind rear surfaces of the two side walls of the insulating housing.

3. The universal serial bus connector as claimed in claim 1, wherein two rear ends of the two side walls of the insulating housing define two face-to-face buckling grooves, fronts of the first main body, the second main body and the third main body are connected with a fastening frame, two opposite side surfaces of the fastening frame protrude outward to form two buckling blocks buckled in the two buckling grooves.

4. The universal serial bus connector as claimed in claim 3, wherein a middle of the fastening frame is defined as an opening, an isolating board is connected with a substantial middle of an inner periphery of the fastening frame to divide the opening into a first opening and a second opening located under the first opening, the first opening communicates with the insertion slots which penetrate through the first main body along the front-to-rear direction, the second opening communicates with the insertion slots which penetrate through the second main body along the front-to-rear direction, a rear of the bottom surface of the fastening frame extends downward to form a supporting block, two opposite sides of a top of the supporting block define two narrow slots respectively communicating with the insertion slots which penetrate through the third main body, the soldering portions and the rear ends of the fastening portions of the terminals are separately inserted into the insertion slots and abut against the resisting surfaces of the dielectric base through the first opening, the second opening and the narrow slots.

5. The universal serial bus connector as claimed in claim 1, wherein a rear end of a top surface of the top wall of the insulating housing is recessed downward to form a fixing groove, and two opposite sides of a rear end of a bottom surface of the bottom wall of the insulating housing protrude downward to form two first fastening blocks, two opposite sides of a front surface of the bottom wall of the insulating housing are recessed inward to form two restricting grooves, the first shielding shell has a top plate, two lateral plates and a bottom plate, a rear end of the top plate is punched downward to form a fixing piece, two opposite sides of a front edge of the bottom plate are bent upward to form two restricting pieces, and two opposite sides of a rear edge of the bottom plate are recessed inward to form two recesses, the first fastening blocks are fastened in the recesses, the fixing piece is fixed in the fixing groove and the restricting pieces are restricted in the restricting grooves.

6. The universal serial bus connector as claimed in claim 5, wherein a front end of the top surface of the top wall of the insulating housing is recessed downward to form a guiding groove passing through a front surface of the top wall, the fixing groove and the guiding groove are arranged in alignment, an inner surface of a rear sidewall of the guiding groove is inclined rearward and upward to form a guiding surface, the fixing piece of the first shielding shell is fixed in the fixing groove along the guiding surface.

7. The universal serial bus connector as claimed in claim 5, wherein two lower portions of the two lateral plates extend rearward to form two connecting plates, each connecting plate defines a clipping hole, the lower shell has a first fastening board extending forward from a front end of the first main board, two first flanks extending upward and perpendicular to the first main board from two opposite sides of the first main board, and connecting with two opposite ends of the first fastening board, two opposite sides of the first fastening board define two first fastening holes, a front end of each first flank is punched inward to form a clipping piece, the first fastening blocks are fastened in the two first fastening holes and the clipping pieces are clipped in the clipping holes, two rear ends of two outer surfaces of the two side walls of the insulating housing protrude outward to form two second fastening blocks, the upper shell has a second fastening board extending forward from a front end of the second main board, and two fastening arms extending downward and perpendicular to the second fastening board from two opposite sides of the second fastening board, each fastening arm defines a second fastening hole, the second fastening blocks are fastened in the second fastening holes.

8. The universal serial bus connector as claimed in claim 7, wherein two portions of a rear end of each first flank are punched outward to form a buckling piece, and a limiting portion located under the buckling piece, the upper shell has two second flanks extending downward and perpendicular to the second main board from two opposite sides of the second main board, each second flank has a buckling hole, the buckling pieces are buckled in the buckling holes, and bottoms of the second flanks resist against tops of the two limiting portions.

9. The universal serial bus connector as claimed in claim 1, wherein the insulating housing includes a connecting wall connected with inner surfaces of the top wall, the two side walls and the bottom wall to divide the receiving space into a first receiving space and a second receiving space, the top wall of the insulating housing includes a base body, a first base board extending forward from a bottom of the base body, and a second base board extending rearward from a top of the base body, the top wall of the insulating housing defines a plurality of first terminal grooves, a substantial middle of each first terminal groove penetrates through a top surface of the first base board, and a rear end of each first terminal groove penetrates through a rear surface of the base body to communicate with the second receiving space, the insulating housing defines two second terminal grooves passing through two opposite sides of a bottom surface of the first base board and two opposite sides of a top of the connecting wall to communicate with the first receiving space and the second receiving space, and two third terminal grooves passing through two opposite sides of a top surface of the bottom wall and two opposite sides of a bottom of the connecting wall to communicate with the first receiving space and the second receiving space, the two side walls of the insulating housing define two fourth terminal grooves passing through two lower portions of two inner surfaces and two rear surfaces thereof and communicating with the first receiving space and the second receiving space, the terminals include five first terminals disposed to the first terminal grooves, a pair of second terminals disposed to the second terminal grooves, a pair of third terminals disposed to the third terminal grooves and a pair of fourth terminals disposed to the fourth terminal grooves.

10. The universal serial bus connector as claimed in claim 9, wherein the fastening portions include first fastening portions of the first terminals, second fastening portions of the second terminals, third fastening portions of the third terminals and fourth fastening portions of the fourth terminals, the contact portions include first contact portions of the first terminals of which each extends forward, then is arched upward and further extends forward from a front end of the first fastening portion, second contact portions of the second terminals of which each extends forward from a front end of the second fastening portion, third contact portions of the third terminals of which each extends downward, and then extends forward from a front end of the third fastening portion, and fourth contact portions of the fourth terminals of which each is bent outward, then bent upward, and further extends forward from a front end of the fourth fastening portion to be exposed to the first receiving space, and the soldering portions include first soldering portions of the first terminals of which each slantwise extends upward and rearward from a rear end of the first fastening portion, second soldering portions of the second terminals of which each slantwise extends upward and rearward from a rear end of the second fastening portion, third soldering portions of the third terminals of which each slantwise extends upward and rearward from a rear end of the third fastening portion, and fourth soldering portions of the fourth terminals of which each slantwise extends upward and rearward from a rear end of the fourth fastening portion to be exposed behind the insulating housing.

* * * * *